United States Patent [19]

Tam

[11] Patent Number: 5,006,821

[45] Date of Patent: Apr. 9, 1991

[54] RF COUPLER HAVING NON-OVERLAPPING OFF-SET COUPLING LINES

[75] Inventor: Ambrose W. C. Tam, Hong Lok Yuen, Hong Kong

[73] Assignee: Astec International, Ltd., Hong Kong

[21] Appl. No.: 407,343

[22] Filed: Sep. 14, 1989

[51] Int. Cl.[5] ..... H01P 5/18

[52] U.S. Cl. ..... 333/116; 333/117

[58] Field of Search ..... 333/109, 115, 116, 117

[56] References Cited

U.S. PATENT DOCUMENTS

| | | | |
|---|---|---|---|
| 2,531,438 | 11/1950 | Jones | 333/112 |
| 2,775,740 | 12/1956 | Oliver | 333/115 |
| 3,297,967 | 1/1967 | Hunton | 333/113 |
| 3,721,912 | 3/1973 | Ross | 333/116 X |
| 3,990,150 | 12/1976 | Caragliano et al. | 333/116 |
| 4,423,392 | 12/1983 | Wolfson | 333/116 |
| 4,692,721 | 9/1987 | Ito et al. | 333/109 |

FOREIGN PATENT DOCUMENTS

| | | | |
|---|---|---|---|
| 1267289 | 5/1968 | Fed. Rep. of Germany | 333/109 |
| 6058 | 1/1977 | Japan | 333/116 |
| 8001225 | 9/1980 | Netherlands | 333/115 |

*Primary Examiner*—Benny T. Lee

*Attorney, Agent, or Firm*—McCubbrey, Bartels, Meyer & Ward

[57] ABSTRACT

An improved radio frequency (RF) coupler for providing two or more secondary signals from a primary RF signal. The RF coupler has a primary coupling element and two or more secondary coupling elements for providing the two or more secondary signals. The secondary RF coupling elements are offset and nonoverlapping with respect to one another along the axis of the primary coupling element so as to reduce the cross coupling and interference between the secondary elements. The offset relationship between secondary coupling elements allows for optimal design control over the coupling between each secondary coupling element and the primary coupling element. In one embodiment, the spatial area required for the coupling elements is reduced by introducing U-shaped portions in the primary coupling element and at least one of the secondary coupling elements. In another embodiment, the secondary coupling elements are provided on separate substrates to further reduce cross interference.

13 Claims, 3 Drawing Sheets

RF COUPLER HAVING NON-OVERLAPPING OFF-SET COUPLING LINES

FIELD OF THE INVENTION

This invention relates to the field of radio frequency circuits and in particular to an improved radio frequency coupler for attenuating a primary radio frequency (RF) signal into two or more secondary signals wherein the two or more secondary coupling elements are offset and non-overlapping along the axis of the primary coupling element of the coupler, such that cross interference between the secondary coupling elements is minimized while at the same time maximizing control of the amount of coupling obtained between each secondary coupling element and the primary coupling element.

BACKGROUND OF THE INVENTION

In the domain of ultra high frequency and radio frequency (RF) circuitry, it is often desirable to generate one or more attenuated RF signals in secondary couplings from a common RF signal received by a primary coupling element.

For example, an RF coupler is a passive device that may be used to control the amplitude and direction of radio frequency signals in a transmission path between circuit modules. An RF coupler may commonly be configured as a stripline coupler, a microstrip coupler or the like. A stripline coupler comprises generally two parallel strips of metal on a printed circuit board. A stripline coupler ordinarily functions as an RF signal attenuator, that is, a device for generating a controlled amount of signal power transfer from one transmission path to another to provide one or more reduced amplitude RF signals.

In prior art radio frequency couplers, stray capacitances and inductances can result in undesirable cross interference between secondary coupling elements since the secondary elements are generally positioned in parallel on opposite sides of the primary coupling element. This can adversely affect circuit performance. The need for reducing cross interference between coupling elements often results in increasing the distance or amount of isolation between the parallel conducting elements. However, increasing the amount of dielectric isolation between parallel conducting coupling elements can result in increasing the amount of parasitic capacitance, thereby reducing the efficiency of the circuit, and also severely inhibiting desired control of RF signal attenuation.

In prior art RF configurations, the need for increased isolation to reduce the effects of stray capacitance and unwanted electromagnetic coupling between secondary coupling elements not only would adversely affect coupler performance but may impose severe speed limitations on high speed digital circuits which are combined with RF circuitry. For example, it is known that the speed of wave propagation in parallel conductor lines is only about two thirds the speed of light due to the solid dielectric spacing material.

A further drawback of prior art stripline couplers is the tendency of the RF coupling to develop parasitic oscillations due to irregularities in the conductor paths. This problem is due in part to the configuration of prior art RF couplers wherein the coupling elements are generally elongated metallic strips which are disposed in parallel. In most prior art RF couplers, an elongated primary coupling element or transmission line is sandwiched between two elongated secondary coupling elements which are disposed in parallel on opposite sides of the primary coupling and extend along the entire length of the primary coupling. This configuration has severe drawbacks in terms of increasing parasitic oscillations due to the elongated parallel conductive paths. A further drawback of this configuration is an increase in parasitic capacitances.

Accordingly, it is apparent that what is needed is an RF coupling structure which minimizes stray capacitances and parasitic oscillations and which also minimizes cross interference between coupled signals. It is also desirable to control the length and gap of the coupling interface between a primary coupling element and each secondary coupling element to control the electromagnetic coupling effect and thereby provide more precise attenuation of the RF frequency while at the same time minimizing the space required for the coupler. Longer length couplers are also desirable to enhance the coupler's directivity i.e. it is important to minimize the amount of reflected energy from the coupler's output that comes back into the coupler.

SUMMARY OF THE INVENTION

In order to overcome the above discussed disadvantages of known RF couplers and attenuators, the present invention provides an improved RF coupler for RF signal transmission which minimizes cross-interference between signals generated by secondary coupling elements in the coupler and minimizes parasitic capacitive effects while at the same time enabling maximum control of the RF coupling interface and consequently the coupling effect.

Preferably, the present invention comprises an improved RF coupler for RF transmission media such as a stripline, microstrip or the like, including an elongated primary coupling element and first and second coupling elements. The primary coupling element has an input end for receiving an RF signal and an output end and a longitudinal axis which defines an RF coupling axis. First and second secondary coupling elements are disposed on respective opposite sides of the primary coupling element for generating corresponding first and second RF signals therefrom. Preferably, these secondary coupling elements are positioned parallel to the RF coupling axis defined by the primary coupling element. A key aspect of the invention is that the first and second secondary coupling elements are offset and longitudinally non-overlapping with respect to one another along the RF coupling axis of the primary coupling element, while at the same time being positioned so as to utilize the entire RF coupling axis defined by the primary coupling element. The terminal ends of the first and second non-overlapping secondary couplings are orthogonal to the plane of those couplings such that RF waves will be transmitted in only one direction. That is, the orthogonally disposed terminal ends block any waves passing through the secondary elements in the opposite direction.

The present invention also provides, in a second embodiment, an improved directional coupler for RF signal transmission media such as stripline, microstrip, or the like, comprising a primary coupling element having an elongated portion and a generally U-shaped portion for defining an RF coupling interface. A first secondary RF coupling element defining a generally U-shaped portion is disposed conformably within and in adjacent parallel relation with said primary coupling U-shaped portion such that a gap between the adjacent U is formed. The U-shaped portion of said first secondary RF coupling has its terminal ends extending orthogonally to the immediately adjacent coupling surface. The orthogonally extending terminal ends have a beveled outside corner for minimizing cross interference with the RF coupling interface provided by the U-shaped portion of said primary coupling. A second secondary coupling element is disposed in parallel relation to and extends along the entire length of said elongated portion of said primary coupling element such that the first and second secondary coupling elements are non-overlapping in relation to one another.

Accordingly, it is the object of the present invention to provide an improved apparatus for electromagnetically coupling an RF signal from a primary coupling element to a plurality of secondary coupling elements which minimizes cross-interference while simultaneously enabling maximum control of the RF coupling interface.

DETAILED DESCRIPTION

Figure 1A:
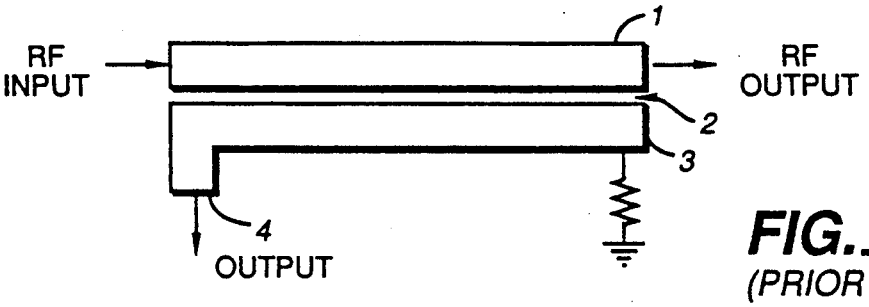
FIG. 1A (PRIOR ART)
FIGS. 1A and 1B are schematics of two prior art RF couplers.
Figure 1B:
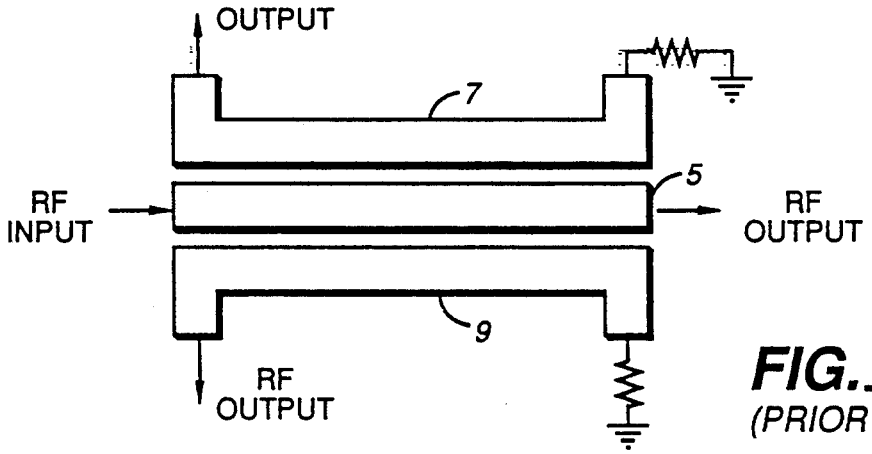
FIG. 1B (PRIOR ART)

FIGS. 1A and 1B show two typical configurations of an RF coupler according to the prior art. As seen in FIG. 1A, primary coupling element 1 is provided for receiving an RF signal at an input end thereof. The primary coupling element also has an output end. A gap 2 is provided between the primary coupling element 1 which receives the RF input signal and a secondary coupling element 3. The RF signal on the primary coupling element 1 is electromagnetically coupled to the secondary coupling element 3 for generating a second RF signal having certain desired characteristics. For example, frequency selectivity is an important aspect in the design of radio frequency circuits. Thus, secondary coupling 3 could provide an attenuated RF signal from the input RF signal. Such an RF circuit can be used to reject a particular RF frequency if desired.

Secondary coupling 3 has an output end for transmission of the generated RF signal. The output end 4 is typically provided to be orthogonal to the plane of the coupling surface so as to prevent a wave from being reflected back to pass through in the opposite direction.

Alternatively, prior art couplers as seen in FIG. 1B may consist of an elongate primary coupling element 5 having an RF coupling axis along its entire length, and first and second secondary coupling elements 7 and 9. First secondary coupling 7 is disposed in generally parallel relation along the entire length of the primary coupling element 5 for electromagnetically coupling the RF signal along the entire length of the primary coupling element 5. Second secondary coupling element 9 is typically disposed on an opposite side of the primary coupling element 5 and in parallel relation to the RF coupling axis for electromagnetically coupling a second RF signal from the primary RF signal on the primary coupling element 5. The terminal ends of the secondary coupling elements 7 and 9 are typically orthogonal to the respective surfaces of the secondary coupling elements.

The dimensions and configuration of the primary and secondary coupling elements are an especially critical aspect of the design of an RF coupler circuit. Even small changes in the configuration of the coupling elements can be extremely important because in the case of an RF circuit, circuit dimensions are often comparable with the wave length of the signal to be attenuated. In a typical prior art RF coupler as shown in FIGS. 1A, 1B the coupling characteristics are determined by the gap between the primary and secondary coupling elements, the width of each element, and the distance or length along which the longitudinal axis of the secondary element is coextensive with the longitudinal or coupling axis of the primary coupling. The gap dimension determines, to a great extent, the amount of coupling that will occur between the coupling elements. The width of the coupling elements defines the impedance matching characteristics of the coupler and the coextensive length of the two coupling elements also affects the amount of coupling that will occur and the directionality of the elements.

However, this prior art coupler thus comprises two or more parallel, elongated conductive strips. Even minor irregularities in the conductive paths of the parallel strips can cause parasitic oscillations which can severely degrade the performance of the RF circuit. In the typical prior art coupler, parasitic oscillations may occur when both output ends of the secondary couplers are connected with active load devices, such as amplifiers or detectors. Such parasitic oscillations are due to unwanted cross-coupling from one secondary to another. Also, there is undesirable interaction between the primary and secondary stages of the coupler, that is, the loading effect of a secondary stage may change the impedance and power of the primary stage, thus causing variations in the coupled power to the other secondary output.

In addition, frequency selectivity of the coupled RF signals can be degraded by parasitic capacitances between the two or more parallel conductive elements. Lastly, where two or more secondary coupling elements are associated with a given primary coupling element, the result is cross interference between these secondary coupling elements.

Figure 2:
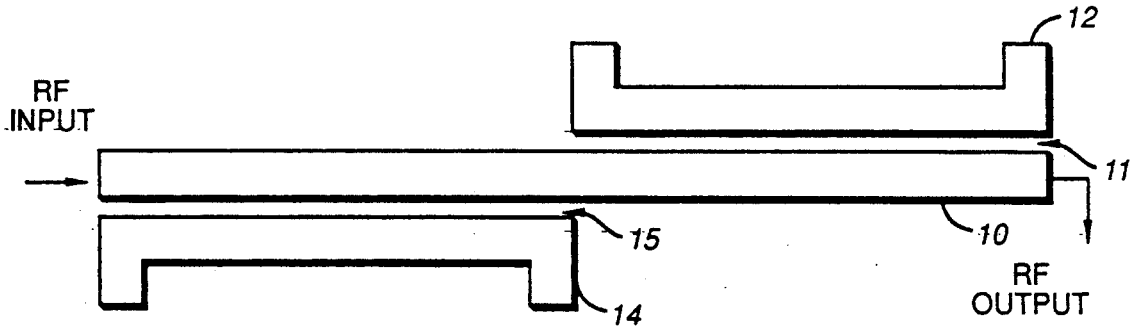
FIG. 2 is a schematic of the RF coupler according to the present invention.

Referring now to FIG. 2, an RF stripline coupler according to the present invention is provided with a primary coupling element 10 for receiving an RF input at an input end thereof. Primary coupling element 10 defines an RF coupling axis along its entire length. Primary coupling element 10 also has an output end for unidirectional transmission of the RF signal. A first secondary coupling element 12 is provided in parallel relation to the RF coupling axis of the primary coupling element 10. The RF signal from primary coupling element 10 is electromagnetically coupled to coupling element 12 across a coupling interface or gap 11. A second secondary coupling element 14 is disposed in parallel relation on a respective opposite side of the primary coupling element 10. The RF signal from primary coupling element 10 is also electromagnetically coupled to coupling element 14 across a coupling interface 15. According to the present invention, the secondary RF coupling elements 12 and 14, respectively, are disposed at opposite ends of the primary coupling element 10 so that the secondary elements 12 and 14 do not overlap with respect to one another in a longitudinal direction. This maximizes the ability to control coupling from the RF coupling axis defined by the primary coupling 10 to the secondary coupling elements 12 and 14 while at the same time minimizing any cross interference between these secondary coupling elements.

In accordance with the present invention, the non-overlapping configuration of the secondary couplings with respect to one another minimizes stray inductance and capacitance between primary and secondary coupling elements and prevents parasitic oscillations, while at the same time maximizing the utilization of the RF coupling axis defined by the primary coupling element 10.

Figure 3:
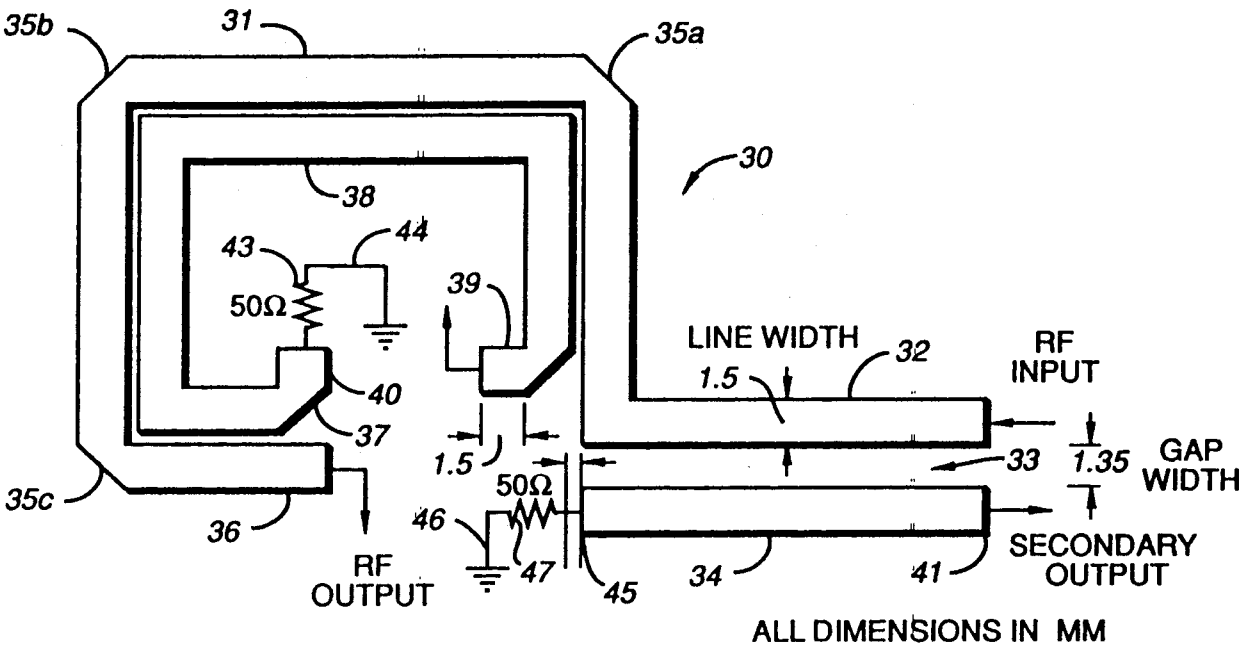
FIG. 3 is an alternate embodiment of the RF coupler of the present invention.

Referring now to FIG. 3, an alternate embodiment of the RF coupler according to the present invention is shown in stripline form on a printed circuit board 20 or the like. This particular embodiment is a so-called dual directional coupler for coupling a portion of an RF signal passing through the primary coupling element to a secondary coupling element such that the RF signal is output in the opposite direction from the output end of the secondary coupling element. However, this embodiment is exemplary only and need not be limited to a directional coupler. For example, the same embodiment could be used as an attenuator for reducing the amplitude of an input RF signal on the primary coupling element and producing an output RF signal with a first selected reduced amplitude on one secondary element and a second selected reduced amplitude on a second secondary element. Additional secondary coupling elements could also be included in this embodiment, although only two are shown.

In the embodiment shown in FIG. 3, a primary RF coupling element 30 has an elongated portion 32 at its input end for receiving an input RF signal, and a generally U-shaped portion 31 for defining an RF coupling surface. Note that the outwardly facing corners 35*a*, 35*b* and 35*c* of U-shaped portion 31 are beveled at an angle of approximately 45 degrees. It has been found that the beveled corners facilitate the speed of wave propagation through the primary coupling element. This is particularly important with respect to high frequency RF signals and high speed digital circuitry which may be associated with the RF coupler. The beveled corners can also reduce the insertion loss of the primary stage of the RF coupler. Moreover, it has also been found that the beveled corners reduce inductance irregularities and thereby greatly aid in preventing cross-interference. It will be appreciated that even slight dimensional improvements such as the beveled corners are especially significant in an RF circuit due to the fact that the RF wavelengths may be comparable with the circuit dimensions of a stripline coupler such as is described herein.

A first secondary RF coupling element 38 defining a generally U-shaped portion congruent with U-shaped portion 31 is conformably disposed within U-shaped portion 31. First secondary U-shaped portion 38 has a complementary surface which is separated by a gap of predefined width from the first U-shaped portion 31. That is, the elongated portions of coupling 38 are in precise parallel relation with corresponding elongated portions of U-shaped coupling 31. It will be appreciated that the spacing between the parallel extending portions of U-shaped coupling 31 and U-shaped coupling 38 is selected to provide the desired amount of electromagnetic coupling of an RF signal from primary coupling element 30 to secondary coupling element 38. Note that the parallel U-shaped configuration of U-shaped portions 31 and coupling element 38 is a substantial improvement over the elongated parallel couplings of the prior art. The U-shaped configuration minimizes the relatively long parallel couplings which can be a source of parasitic oscillations and significantly reduces the amount of space required for forming the coupler on the PC board or the like.

U-shaped coupling 38 has terminal ends 39 and 40 which are disposed orthogonally to the immediately adjacent coupling surface. The outside corners of orthogonally extending terminal portions 39 and 40 are also beveled at a 45 degree angle as shown at 37. This prevents cross interference with the output end 36 of primary coupling element 30. The beveled corner of terminal portion 39 also prevents cross interference with the input portion 32 of primary coupling 30.

Terminal end 40 of secondary coupling 38 is provided with a ground lead 44 which provides a conductive path to ground through resistor 43. Resistor 43 is typically a 50 ohm resistor which may be fabricated in accordance with well known stripline techniques. It will be appreciated that the internal grounded portion of secondary coupling 38 is important in preventing cross interference and in eliminating parasitic capacitance.

A second secondary coupling element 34 is also disposed in a parallel relation with Primary coupling 30 co-extensive with elongated portion 32. Secondary coupling element 34 and elongated portion 32 are separated by a gap width 33. An exemplary value of gap width 33 is 1.35 mm. Secondary coupling 34 has an output end 41 for providing a secondary output of the RF signal with a directional change of that signal. The opposite terminal end 45 of secondary coupling 34 is provided with a lead 46 which is connected to ground through a resistor 47. It will be appreciated that the path to ground through resistor 47 provides a means for preventing the build-up of parasitic capacitances between primary coupling element 30 and secondary coupling element 34. It is most important that secondary coupling 34 be non-overlapping with respect to secondary coupling element 38. This significantly minimizes cross interference between these secondary couplings. In one embodiment of the present invention, as shown in FIG. 3, primary coupling 30 and secondary couplings 34 and 38 each have a line width of substantially 1.5 mm.

Figure 4:
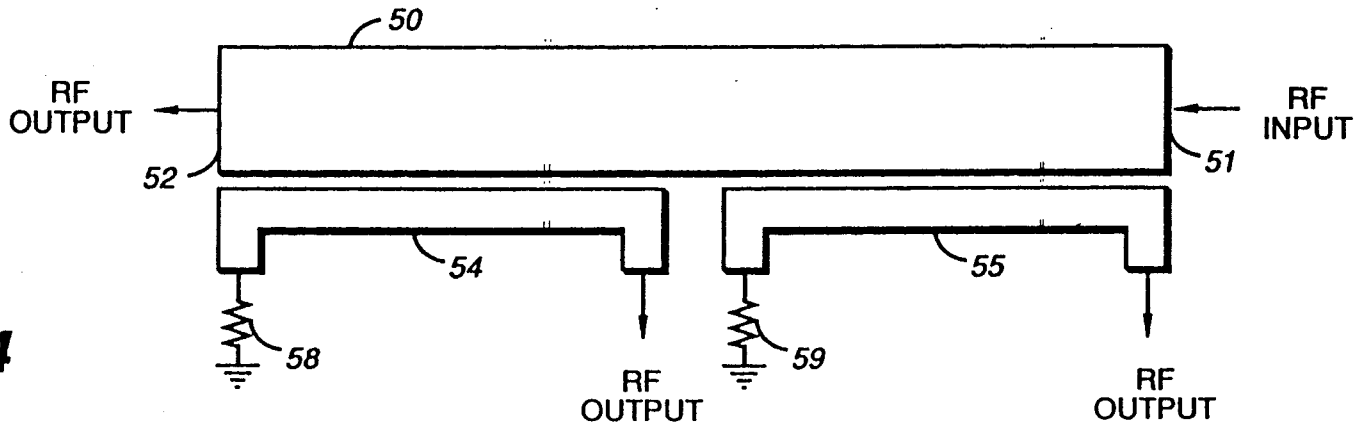
FIG. 4 is another alternate embodiment of the RF coupler of the present invention.

An alternate embodiment of an RF coupler is shown at FIG. 4. A primary RF coupling element 50 has an input end 51 for receiving RF signal and an output end 52. A first secondary coupling element 54 is disposed at one end of the primary coupling element 50 and a secondary coupling element 55 is disposed at the input end of the primary coupling element 50. In accordance with the invention, both secondary coupling elements 54 and 55 are non-overlapping with respect to each other in order to minimize cross-interference and provide maximum isolation. In addition, the terminal ends of secondary couplings 54 and 55 are provided with resistors 58 and 59, respectively which provide a conductive path to ground. Resistors 58 and 59 are fabricated in accordance with well known stripline techniques. The grounded terminal ends of secondary couplings 54 and 55 are also important in preventing cross-interference and in eliminating parasitic capacitance.

Figure 5:
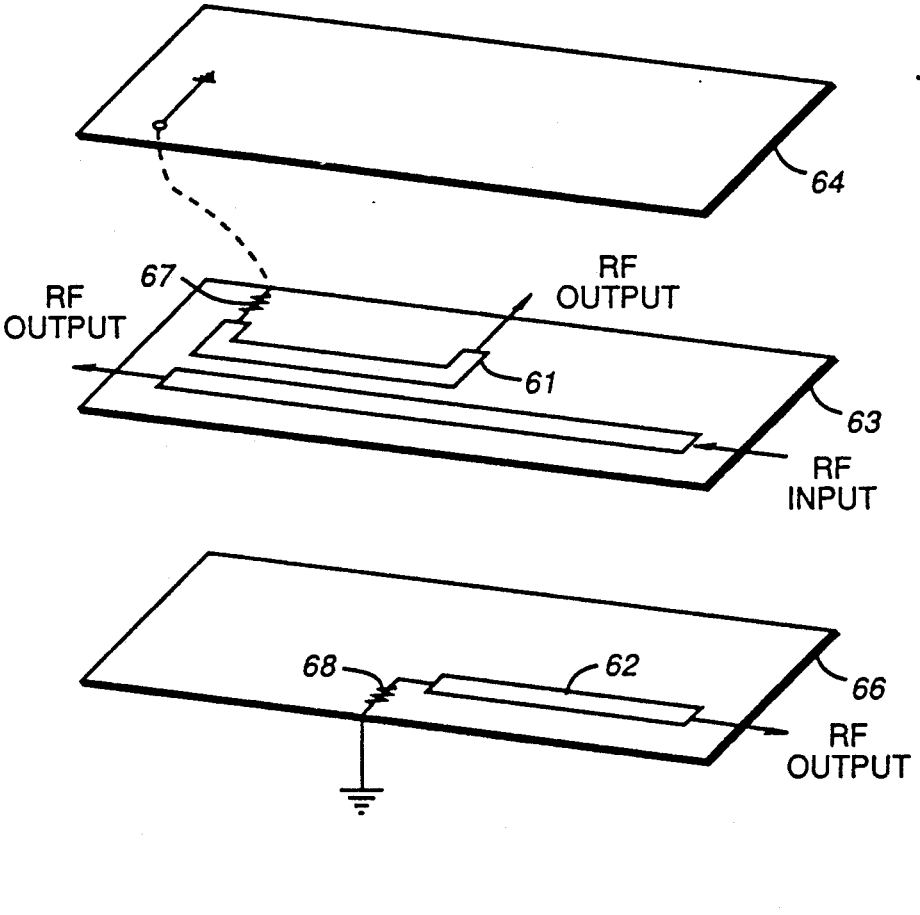
FIG. 5 is another exploded perspective view of an alternate embodiment of the RF coupler of the present invention.

Referring now to FIG. 5, an RF stripline coupler according to the present invention is provided wherein secondary coupling elements 61 and 62, respectively are provided on separate substrates 63 and 66, respectively. Substrates 63 and 66, together with a ground plate substrate 64, comprise a printed circuit board. An RF input signal is provided at an input end of a primary coupling element 65. Primary coupling element 66 is provided at a first substrate, 63. Secondary coupling element 61 is provided at the output end of primary coupling element 65 and is also fabricated according to well known stripline techniques on first substrate 63. Secondary coupling element 61 has an RF output end and a terminal end connected through resistor 67, to ground plate substrate 64. A separate secondary coupling 62 is fabricated on a third substrate 66. Secondary coupling 62 is non-overlapping with respect to coupling 61 in a direction perpendicular to the plane defined by said first substrate In accordance with the present invention, secondary coupling 62 is provided in a non-overlapping relation with respect to secondary coupling 61. Accordingly, primary coupling 65, secondary coupling 61 and secondary coupling 62 are each provided on a separate substrate for minimizing cross-interference. Secondary coupling 62 also has a resistor 68 disposed at its terminal end for providing a conductive path to ground on the third substrate 66.

In accordance with the present invention, an improved RF stripline coupler is provided which minimizes cross interference, as well as parasitic capacitances and parasitic oscillations between primary and secondary coupling elements. At the same time the present invention maximizes the coupling interface between the primary and secondary coupling elements. This provides greatly increased control of the frequencies of the RF signals which are coupled in the secondary coupling elements. The non-overlapping relation of secondary coupling elements minimizes the significant problem in the prior art of cross interference between multiple secondary coupling elements in the coupler along with minimizing parasitic oscillations and capacitances.

While the invention has been described in connection with what is presently considered to be the most practical and preferred embodiments, it is to be understood that the invention is not limited to the disclosed embodiment but, on the contrary is intended to cover various modifications and equivalent arrangements included within the spirit and scope of the appended claims. For example, the congruent U-shaped portions could be any convenient shape for maximizing the extent of the RF coupling interface in a small area while at the same time maintaining a minimum amount of isolation from the primary coupling and being disposed in a non-overlapping arrangement with any additional secondary couplings. Therefore, persons of ordinary skill in this field are to understand that all such equivalent structures are to be included within the scope of the following claims.

What is claimed is:

1. An RF coupler for RF transmission media, such as stripline and microstrip, comprising:

a primary RF coupling element having an input end for receiving an RF signal and an output end for transmitting said RF signal, said primary RF coupling element provided on a first substrate;

a first coupling means provided on said first substrate such that said first coupling means is a predetermined distance from said primary RF coupling element for coupling an RF signal of a desired wavelength from said primary coupling element, said first coupling means having an output end for transmitting said coupled signal and a terminal end coupled to a ground on a second substrate; and a second coupling means provided on a third substrate underlying said first substrate for coupling a second desired RF signal from said primary coupling element, said second coupling means disposed at a predetermined distance from said primary coupling element and positioned so as to minimize cross-interference with said first coupling means, said second coupling means having an output end for transmitting said coupled RF signal and a terminal end coupled to ground on said third substrate.

2. An RF coupler according to claim 1 wherein said primary RF coupling element comprises a conductive strip line and wherein said first and second coupling means are offset with respect to one another along a direction aligned with said strip line.

3. An RF coupler apparatus for RF signal transmission media, such as stripline and microstrip, comprising:

a first coupling element for defining an RF coupling interface having an elongate input end for receiving an RF signal, said input end extending into a first generally U-shaped portion integral therewith;

a second RF coupling element defining a second generally U-shaped portion disposed congruently with and in isolated parallel relation to said U-shaped portion of said first coupling element such that the extent of an RF coupling interface formed between said parallel adjacent U-shaped portions is maintained at a maximum for an area defined by said U-shaped portions and wherein said second RF coupling element has an output end for transmitting a coupled RF signal and an opposite end having a connection with ground; and a third RF coupling element disposed in parallel adjacent relation with said elongate input end of said first RF coupling element and having an output end for transmitting a coupled RF signal and an opposite end coupled with ground such that said second and third RF coupling elements are in a non-overlapping relation with one another.

4. An RF coupler for RF transmission media, such as stripline and microstrip, comprising:

a primary RF coupling element having an elongate input end for receiving an RF signal and extending into a U-shaped portion for defining an RF coupling interface;

a first coupling means for coupling a desired RF signal from said primary RF coupling element, said first coupling means disposed in parallel adjacent relation with said elongate input end; and a second coupling means congruent with said U-shaped portion of said primary coupling element and maintained at a minimum distance from said primary element such that a desired RF signal is coupled from said primary element to said second coupling means and wherein said first and second RF coupling means are offset in a non-overlapping relation with respect to one another.

5. An apparatus as in claim 4 wherein said primary coupling element and said first and second coupling means comprise conductive strip lines having a line width of at least 1.5 mm.

6. An apparatus according to claim 4 wherein said second congruent U-shaped coupling means includes a first adjacent portion disposed in a direction substantially perpendicular with said elongated input end, a second adjacent portion coupled to said first adjacent portion at a first corner, a third adjacent portion coupled to said second adjacent portion at a second corner, a fourth adjacent portion coupled to said third adjacent portion at a third corner, said second portion substantially perpendicular to said first and third adjacent portions, said first and third adjacent portions substantially parallel to one another, and said fourth portion substantially parallel to said second portion and substantially perpendicular to said third portion.

7. An apparatus according to claim 6 wherein said second congruent U-shaped coupling means includes an output end for transmitting said coupled RF signal and an opposite end coupled to ground, said output end coupled to said first adjacent portion at a fourth corner and said opposite end coupled to said fourth adjacent portion at a fifth corner, said output end substantially perpendicular to said first adjacent portion and said opposite end substantially perpendicular to said fourth adjacent portion.

8. An apparatus according to claim 7 wherein said fourth corner includes an outer periphery away from said output end and said first adjacent portion, said fourth corner periphery beveled at substantially 45 degrees with respect to said output end and said first adjacent portion, and wherein said fifth corner includes an outer periphery away from said opposite end and said fourth adjacent portion, said fifth corner periphery beveled at substantially 45 degrees with respect to said opposite end and said fourth adjacent portion.

9. An apparatus according to claim 4 wherein said first coupling means has an output end for transmitting said coupled RF signal and an opposite end coupled to ground.

10. An apparatus according to claim 4 wherein said U-shaped portion of said primary element includes a first adjacent portion coupled to said elongated input end of said primary element, a second adjacent portion coupled to said first adjacent portion at a first corner, a third adjacent portion coupled to said second adjacent portion at a second corner, said first adjacent portion substantially perpendicular to said elongated input end, said second portion substantially perpendicular to said first and third adjacent portions, and said first and third adjacent portions substantially parallel to one another.

11. An apparatus according to claim 10 wherein said U-shaped portion of said primary element further includes a fourth adjacent portion coupled to said third adjacent portion at a third corner, said fourth adjacent portion substantially perpendicular to said third adjacent portion and substantially parallel to said second adjacent portion.

12. An apparatus according to claim 11, wherein said third corner includes an outer periphery away from said third and fourth adjacent portions, said third corner periphery beveled at substantially 45 degrees with respect to said third and fourth adjacent portions.

13. An apparatus according to claim 10 wherein said first corner includes an outer periphery away from said first and second adjacent portions, said first corner periphery beveled at substantially 45 degrees with respect to said first and second adjacent portions, and wherein said second corner includes an outer periphery away from said second and third adjacent portions, said second corner periphery beveled at substantially 45 degrees with respect to said second and third adjacent portions.

* * * * *